United States Patent [19]

Sando et al.

[11] 4,164,051

[45] Aug. 14, 1979

[54] CONTINUOUS DYEING METHOD FOR THICK TEXTILE MATERIALS

[75] Inventors: Yoshikazu Sando; Hiroshi Ishidoshiro, both of Wakayama, Japan

[73] Assignee: Sando Iron Works, Co. Ltd., Wakamama, Japan

[21] Appl. No.: 935,879

[22] Filed: Aug. 23, 1978

[30] Foreign Application Priority Data

Sep. 5, 1977 [JP] Japan ..... 52-106517

[51] Int. Cl.[2] ..... D06B 1/02; D06B 21/00

[52] U.S. Cl. ..... 8/149.1; 8/151; 68/5 D; 68/62; 68/158; 68/205 R

[58] Field of Search ..... 8/149.1, 151, 158; 68/5 D, 200, 205 R

[56] References Cited

FOREIGN PATENT DOCUMENTS 2405314 8/1975 Fed. Rep. of Germany ..... 68/205 R

*Primary Examiner*—Philip R. Coe

*Attorney, Agent, or Firm*—Toren, McGeady and Stanger

[57] ABSTRACT

A method for continuously dyeing a thick textile material such as a blanket or carpet material or the like. The thick textile material is arranged to be continuously pulled upward and guided over a slanting plate from a lower position to a higher position. A nozzle tube is arranged to spray a dye solution at the thick textile material in an atomized state while the textile material is on the move being guided upward along the slanting plate. The spraying quantity of the dye solution discharged out of the nozzle tube is set to have all of the sprayed quantity of the dye solution absorbed by the thick textile material without having any superfluous portion of the solution flowing down and yet to ensure sufficient impregnation of the textile material with the dye solution. The textile material impregnated with the dye solution is further continuously fowarded and passed through a hygro-thermic treatment chamber and a water washing device.

1 Claim, 2 Drawing Figures

CONTINUOUS DYEING METHOD FOR THICK TEXTILE MATERIALS

BACKGROUND OF THE INVENTION

1. Field of the Invention

This invention relates to a method for continuously dyeing a thick textile material usable as carpet or the like.

2. Description of the Prior Art

In order to continuously dye a thick textile material that is broad and long for use, for example, as carpet or blanket, a dye solution must be first applied to the thick textile material. Heretofore, a dye solution has been applied to such a thick textile material by dipping the textile material in a dye solution contained in a container to cause the material to be impregnated with the solution and then by squeezing the material through a wringer roll arrangement to adjust the impregnating quantity of the solution. Following this, the material impregnated with the dye solution has been subjected to a heating treatment. However, the conventional dye solution applying process has a serious shortcoming. After a broad, long and thick textile material is impregnated with a dye solution as described in the foregoing, when the dye solution is squeezed out by the wringer roll arrangement, the impregnating quantity distribution tends to become uneven because the broad textile material necessitates the use of long wringer rolls. The long rolls tend to have flexures, which result in a relatively strong nipping pressure on two edge portions of the textile material and a relatively weak nipping pressure on the middle part of the material. The wringing process is thus unevenly carried out. Further, since the textile material is thick, the wringing degree on the surface portion of the material differs from that of the core portion. Then, excessive wringing effected on the surface portion makes it impossible to dye the surface of the textile material in a dense color. Conversely, a correct degree of wringing on the surface portion makes the dye solution impregnating degree in the core portion of the textile material excessive and thus results in waste of the dye solution.

On the other hand, a batch type dyeing process which has been conventionally employed in wasteful of heat energy, dye, water, etc. and hardly meets requirement for saving resources and energy. In addition to this problem, the results of batch dyeing process are uneven and inconstant and tends to include unacceptable products.

SUMMARY OF THE INVENTION

The present invention is directed to the solution of such problems of the conventional processes.

It is thus an object of this invention to provide a method in which a dye solution applying mechanism is arranged to apply always a predetermined quantity of a dye solution uniformly to a moving thick textile material; and then the textile material impregnated with the dye solution is arranged to continuously pass through a hydro-thermic treatment chamber and a washing device to carry out continuous dyeing.

The above and further objects, advantages and features of the present invention will become apparent from the following detailed description of a preferred embodiment taken in connection with the accompanying drawings.

BRIEF DESCRIPTION OF THE DRAWINGS

The accompanying drawings show as preferred embodiment a dyeing apparatus to be used for carrying out the continuous dyeing method of the present invention. In the drawings.

DETAILED DESCRIPTION OF PREFERRED EMBODIMENT

Figure 1:
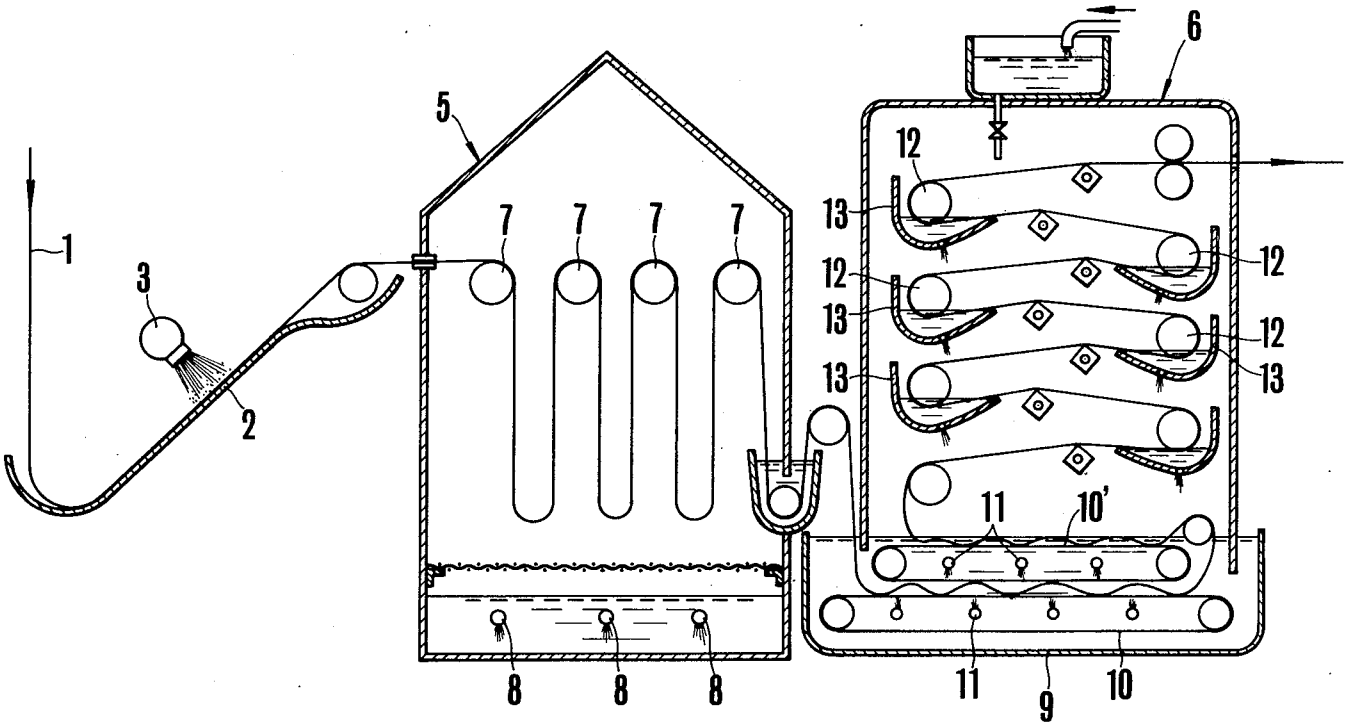
FIG. 1 illustrates the whole apparatus and FIG. 2 a dye solution spraying nozzle tube.
Figure 2:
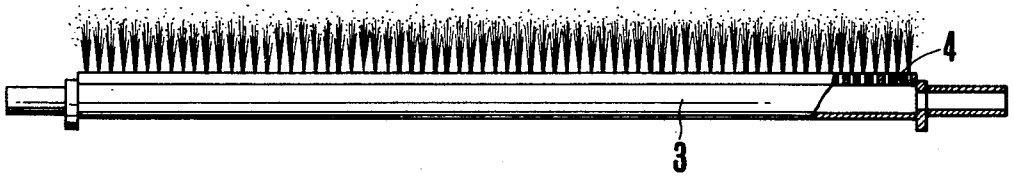

Referring to the accompanying drawings, a reference numeral 1 indicates a thick textile material to be used for carpets, blankets or the like, such as a wool planted thick textile material. The thick material 1 is arranged to move upward over a slanting plate 2. A nozzle tube 3 extends in the direction of width of the thick textile material 1 and is arranged to spray a dye solution at the thick textile material 1 while it is on the move over the slanting plate 2. The nozzle tube 3 is provided with spray nozzles 4 arranged in the direction of a bus line of the nozzle tube 3 as shown in FIG. 2. The dye solution is supplied to the inside of the nozzle tube with pressure and is discharged in an atomized state. The quantity of the dye solution to be discharged from the spray nozzles 4 and the travelling speed of the thick textile material are set in such a manner as to have the whole discharged dye solution absorbed by the thick textile material. Thus, the dye solution discharged from the nozzle tube is sprayed at the textile material and the whole discharged quantity of the dye solution is absorbed by the thick textile material 1 before the material is forwarded to the inside of a hygro-thermic treatment chamber 5. The dye solution is then fixed to the thick textile material through the action of humid heat while the latter is conveyed within the hygro-thermic treatment chamber in a zigzag manner. After the hygro-thermic treatment, the textile material is guided out of the hygro-thermic treatment chamber 5 and is washed within a washing device 6 to complete a series of steps of the dyeing process.

A reference numeral 7 indicates textile material guide rolls arranged within the hygro-thermic treatment chamber 5; 8 indicates steam supply tubes; 9 indicates a water tank constituting the bottom part of the washing device 6. Inside the water tank 9, there are provided endless net conveyers 10 and 10', which are arranged in the upper and lower parts of the tank with a space between them. While the textile material 1 is conveyed through the space between the upper and lower net conveyors 10 and 10', air is discharged from air tubes 11 to shake the textile material in water contained inside the water tank, so that a higher effect of washing with the water can be attained. The textile material which has undergone a primary washing treatment in this manner is caused to further travel zigzag by guide rolls 12 arranged above the water tank 9. Then, during its zigzag travel, the textile material 1 is subjected to a secondary washing treatment through water contained in water washing trays 13 which are arranged to confront these guide rolls.

The hygro-thermic treatment chamber 5 and the water washing device 6 in the above described embodiment example are covered by another patent application which has already been filed. Besides, they do not constitute the subject matter of the present invention. Therefore, the details of the structural arrangement of the hygro-thermic treatment chamber 5 and water washing device 6 and the effect attainable therefrom are omitted from the description herein.

The foregoing is an embodiment example of the dyeing process of the present invention. The embodiment includes: To spray the dye solution gradually at a textile material 1 by means of the spraying nozzles 4 while the textile material is on the move; and the spraying amount of the dyeing solution is set to allow the moving textile to absorb the dye solution in sufficient quantity and yet not to have any superfluous portion of the solution dripped down therefrom. The atomized dye solution is sprayed at the textile material 1. The spraying pressure forces the dye solution to come into the core portion of the thick textile material, so that the inside of the textile material also can be dyed. The dye solution is set to be sprayed in such quantity that can be absorbed sufficiently and not superfluously. Thus, the invented method obviates the necessity of a wringing process and ensures homogeneous impregnation of the whole moving thick textile material with the dye solution without the use of wringer rolls, so that the dye can be prevented from being wasted.

Further, in accordance with the invention, the thick textile material is continuously dyed by passing it through the hygro-thermic treatment chamber 5 and the washing device 6 after it has been impregnated with the dye solution. As compared with the conventional batch process, the invented method not only permits saving energy, resources and labor but also permits uniform dyeing. Besides, since no wringer roll arrangement is required, shifting the dye solution from one color to another for dyeing into different colors can be effected with a much greater ease.

What is claimed is:

1. A method for continuously dyeing a thick textile material such as a blanket or carpet material or the like wherein the thick textile material is continuously pulled upward and guided over a slanting plate from a lower position to a higher position; spraying from a nozzle tube a dye solution at the thick textile material while it is being guided upward over said slanting plate; setting the spraying quantity of said dye solution discharged out of the nozzle tube such that the entire sprayed quantity of the dye solution is absorbed by the thick textile material without having any portion thereof flowing down off the textile material while ensuring sufficient and even impregnation of the textile material with the dye solution without necessitating provision of any wringing roll arrangement downstream of the nozzle tube; and then continuously passing the thick textile material thus impregnated with the dye solution through a hygro-thermic treatment chamber for dye fixation and then through a device for washing with water.

* * * * *